United States Patent [19]

Beér

[11] Patent Number: 4,845,940

[45] Date of Patent: Jul. 11, 1989

[54] LOW NOX RICH-LEAN COMBUSTOR ESPECIALLY USEFUL IN GAS TURBINES

[75] Inventor: János M. Beér, Winchester, Mass.

[73] Assignee: Westinghouse Electric Corp., Pittsburgh, Pa.

[21] Appl. No.: 117,369

[22] Filed: Oct. 28, 1987

Related U.S. Application Data

[63] Continuation of Ser. No. 488,145, May 25, 1983, abandoned, which is a continuation of Ser. No. 238,668, Feb. 27, 1981, abandoned, which is a continuation of Ser. No. 661,264, Oct. 15, 1984, abandoned, which is a continuation of Ser. No. 15,539, Feb. 13, 1987, abandoned.

[51] Int. Cl.[4] ..... F02C 1/00; F02G 3/00

[52] U.S. Cl. ..... 60/732; 60/748; 60/757

[58] Field of Search ..... 431/10, 351, 352; 60/759, 757, 748, 732

[56] References Cited

U.S. PATENT DOCUMENTS

| | | | |
|---|---|---|---|
| 1,322,999 | 11/1919 | Bester . | |
| 2,617,255 | 11/1952 | Niehus . | |
| 2,884,759 | 5/1959 | Sevcik | 60/757 |
| 3,352,106 | 11/1967 | Pianko | 60/758 |
| 3,485,043 | 12/1969 | Ehrich | 60/757 |
| 3,490,230 | 1/1970 | Pillsbury et al. . | |
| 3,702,058 | 11/1972 | De Corso et al. . | |
| 3,736,747 | 6/1973 | Warren . | |
| 3,831,854 | 8/1974 | Sato et al. . | |
| 3,859,786 | 1/1975 | Azelborn et al. | 60/737 |
| 4,174,608 | 11/1979 | Hunyadi et al. | 60/757 |
| 4,262,487 | 4/1981 | Glenn | 60/757 |

OTHER PUBLICATIONS

Carlstrom, L. A. et al. "Improved Emissions Performance in Today's Combustion System", AEG/SOA 7805, Jun. 1978, p. 17.

*Primary Examiner*—Louis J. Casaregola
*Assistant Examiner*—Timothy S. Thorpe
*Attorney, Agent, or Firm*—E. F. Possessky

[57] ABSTRACT

A combustor capable of reducing the noxious emissions such as fuel bound and thermal nitrogen oxide products, during combustion of high nitrogen bearing and high aromatic content fuels is disclosed. The combustor includes a plurality of substantially concentric pipes defining annular passages with annular divergent nozzles. The divergent nozzles may be formed by rings having a venturi shaped axial section to facilitate fast mixing of axially supplied air between adjacent annular passages. The longitudinal spacing between at least two adjacent nozzles defines first and second divergent cavities. A fuel rich torodial vortex is formed in proximity to a central fuel jet in the first cavity and advantageously converts fuel bound nitrogen to $N_2$. A fuel lean torodial vortex formed in the second cavity mixes hot combustion products with additional gaseous reactant to complete the combustion while avoiding locally high temperatures, and thus thermal NOx formation. A ring of jet nozzles radially injects relatively small amounts of high pressure gaseous reactant or steam to form a throat to separate and stabilize the vortices. Alternatively, the pipe extending between the two cavities can include a convergent and divergent portion forming the throat between the cavities for separating and reinforcing the toroidal vortices. Guide vanes may be positioned in the annular passages to swirl the gaseous reactant entering the cavities to assist in the formation of the toroidal vortices.

30 Claims, 2 Drawing Sheets

Fig. 2
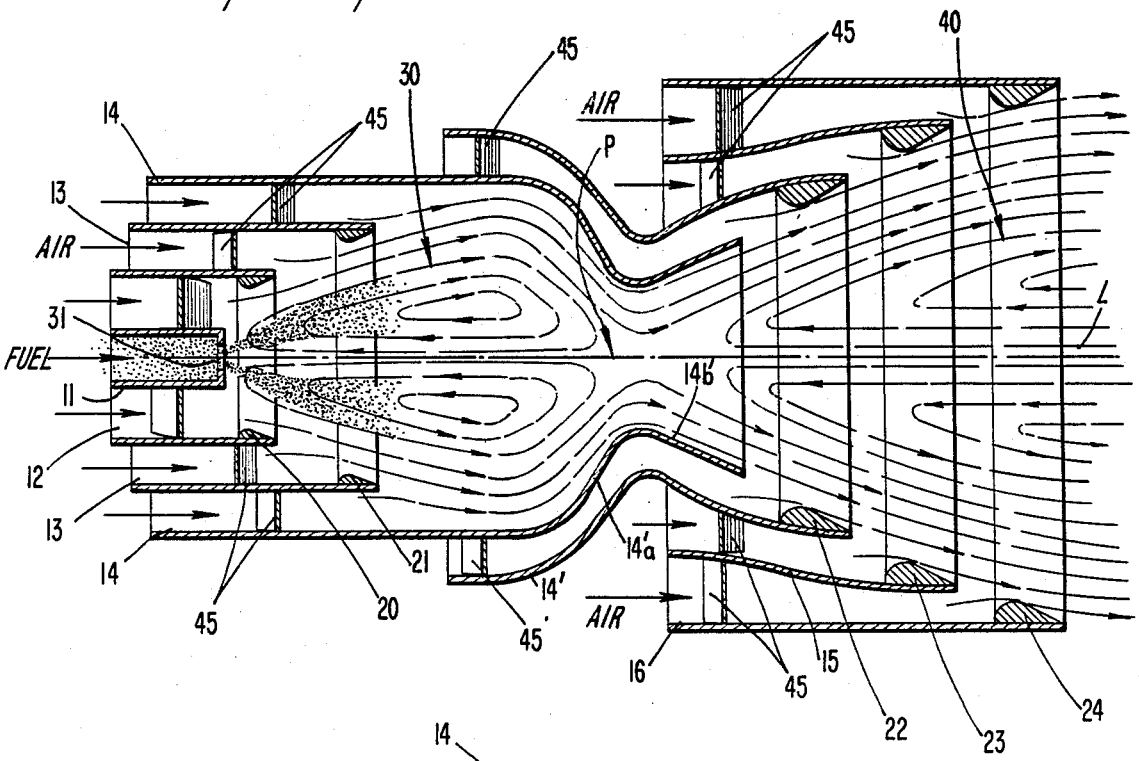
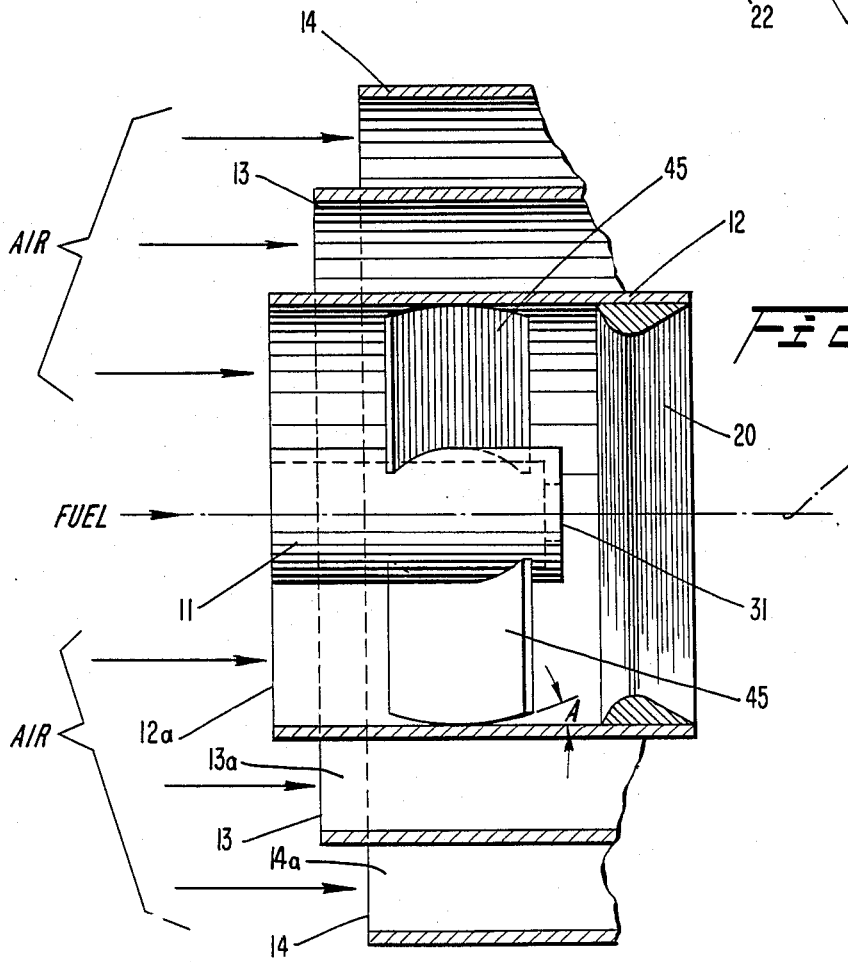
Fig. 3

LOW NOX RICH-LEAN COMBUSTOR ESPECIALLY USEFUL IN GAS TURBINES

This application is a continuation of Ser. No. 488,145, filed May 25, 1983, now abandoned, which is a continuation of Ser. No. 238,668, filed Feb. 27, 1981, now abandoned, which is a continuation of Ser. No. 661,264, filed Oct. 15, 1984, now abandoned, which is a continuation of Ser. No. 015,539, filed 2/13/87, now abandoned.

TECHNICAL FILED

This invention relates generally to gas turbine combustors and more particularly, to two-stage combustors capable of developing separate fuel rich and fuel lean zones for improved combustion and to minimize formation of nitrogen oxide (NOx) products.

BACKGROUND ART

Combustors are used in gas turbines for developing high pressure gases used in the generation of turbine power. In such turbine systems, gaseous reactant and fuel supplied by a compressor to a combustion chamber of the combustor are ignited and discharged into the inlet side of a turbine. The present practice is to use relatively refined fuels, such as kerosene or diesel fuels, or natural gas, that previously were relatively easily available; the gaseous reactant may be air, oxygen or oxygen enriched air, or carbon dioxide. By mixing and igniting the fuel and gaseous reactant, high volumetric heat release rates can be obtained under turbulent conditions by matching the concentrations and directions of fuel and gaseous reactant flow in a manner enabling high fuel concentration regions to overlap with regions of large shear stresses in the gaseous reactant flow, as disclosed in my British Pat. No. 1,099,959, issued Jan. 17, 1968.

It is recognized as desirable, especially in light of the energy shortage, to be able to use lower grade fuels, such as high nitrogen bearing, high aromatic content petroleum fuels, shale oils and coal liquids, for turbine power.

The major problems, in addition to efficiency and proper mixing of the gases and these fuels, are flame stabilization, elimination of pulsation and noise, and control of pollutant emissions, especially carbonaceous particulates and nitrogen oxides (NOx). Nitrogen oxides emitted from combustion processes have two main sources; namely, the fixation of atmospheric nitrogen from the combustion air at high temperatures, and the conversion of organically bound nitrogen compounds in the fuel to NOx. When the nitrogen content of the fuel exceeds 0.1% by weight, the fuel bound nitrogen plays an increasingly significant role in the emission of NOx. However, the laws governing formation of NOx from these two major sources are quite different. For example, the formation of NOx from atmospheric nitrogen is primarily dependent upon combustion temperature, and generally referred to as "thermal NOx"; whereas, the rate of formation of NOx from organically bound nitrogen in the fuel, generally referred to as "fuel NOx", is largely dependent upon local fuel-air mixture ratios and to a lesser extent upon temperature.

To minimize conversion of fuel bound nitrogen to NOx, it is necessary to first pyrolyse the fuel by heating it in an oxygen deficient environment, followed by admixing the combustion products and combustion air to complete the combustion process. Recent research has shown that given fuel rich conditions and sufficient residence time and temperature in the first or pyrolysis stage of the combustion process, fuel bound nitrogen may be rendered innocuous for NOx formation in the fuel lean second stage. This occurs through conversion to molecular nitrogen ($N_2$) in the fuel rich first stage. However, care has to be taken when the rest of the combustion air is admixed to avoid locally high temperatures resulting in the formation of thermal NOx. This is achieved by admixing of combustion air and products of pyrolysis such that the temperature of the mixture is initially reduced by rapid mixing. This effects quenching of the reactions that would otherwise lead to the formation of thermal NOx. Downstream, a temperature rise occurs due to the up take of the oxygen by the pyrolysis products and exothermic combustion reactions. To effectuate these conditions, the temperature history of the mixture has to be closely controlled to insure that the combustion of soot and hydrocarbons may proceed to completion within the residence time in the combustor while maintaining temperatures in the lean stage below 1600° K.

It is accordingly an object of the present invention to provide a combustor capable of minimizing the formation of nitrogen oxide products by tailoring the mixing and temperature history of the fuel according to known thermodynamic and chemical kinetic requirements of the combustion process.

Another object of the present invention is to provide a combustor comprising first and second combustion zones wherein a first fuel rich zone minimizes the conversion of fuel bound nitrogen to NOx and the second fuel lean zone fast mixes the combustion products from the first zone with combustion air at temperatures sufficiently low to prevent formation of thermal NOx.

Still another object of the present invention is to provide a combustor wherein cooling of the combustor walls is recuperative and capable of reducing heat loss in the fuel rich zone, without using any part of the gaseous reactant for film cooling.

Yet another object is to provide a combustor capable of achieving good control of the flow and mixing pattern while minimizing the pressure drop through the combustor.

Still a further object is to provide a combustor capable of maintaining temperatures sufficiently high for complete combustion without the formation of NOx products.

DISCLOSURE OF INVENTION

The gas turbine combustor of the present invention is capable of reducing the emission of fuel bound and thermal nitrogen oxide products during combustion of high nitrogen bearing and high aromatic content fuels, and comprises a plurality of substantially concentric pipes defining annular passages having central and annular openings located at one end of the pipes for receiving fuel and swirling gaseous reactant. A plurality of substantially concentric annular divergent nozzles are positioned within the passages, and the longitudinal spacing between at least two adjacent nozzles defines first and second divergent cavities formed by the nozzle ends. The first cavity is formed in proximity to a central fuel injector to create a first stage fuel rich zone, and the second divergent cavity is positioned downstream from the first cavity forming a second stage fuel lean zone, whereby complete combustion is effected. The spacing between the nozzles within the first and second cavities is conducive to forming fuel rich and fuel lean toroidal vortices respectively in each cavity. Preferably, the axial spacing of adjacent nozzles forming the first cavity increases relative to the radial distance from the combustor axis. This geometrical pattern forms an envelope with substantially concave boundaries; whereas, constant axial spacing of nozzles forming the second cavity defines substantially straight line boundaries.

Throat means is positioned between the first and second cavities of the combustor for separating and reinforcing the fuel rich and fuel lean vortices. In a first embodiment, such means includes a ring jet circumferentially positioned around the combustor for radially injecting small amounts of high pressure gaseous reactant directly into the fuel rich vortex in proximity to a stagnation point of the vortex. In a second embodiment of the present invention, such means preferably includes a throat section of the concentric pipe located between the two adjacent nozzles. The throat section includes a convergent portion, and a divergent portion integrally formed therewith and downstream from the convergent portion. This structure provides separating and reinforcing action to the formation of the gaseous toroidal vortices.

Swirl generating means is positioned in the concentric passages for imparting a swirl velocity component to gaseous reactants axially supplied through the annular passages, enabling rotation of the gaseous reactant for forming the toroidal vortices. Such means preferably includes a plurality of turbine stator-type guide vanes fixedly attached at spaced circumferential intervals within the annular passages at a predetermined vane angle. The guide vane angles can be adjusted for achieving greatest swirl velocity in an innermost annular passage communicating with the first cavity, and a swirl velocity gradually decreasing with increasing radial distance from the longitudinal axis of the combustor.

The divergent nozzles of the combustor are preferably formed by a ring having a venturi shaped axial section. This geometry facilitates fast mixing of axially supplied air between adjacent annular passage for maximum combustion efficiency, and thus minimum pollution.

Additional objects, advantages and novel features of the invention will be set forth in part in the description which follows and in part will become apparent to those skilled in the art upon examination of the following or may be learned by practice of the invention. The objects and advantages of the invention may be realized and obtained by means of the instrumentalities and combinations particularly pointed out in the appended claims.

BRIEF DESCRIPTION OF DRAWING

FIG. 2 is a schematic view of a second embodiment according to the present invention showing the use of a convergent-divergent throat section for separating and strengthening the toroidal vortices in the first and second combustion cavities; and FIG. 3 is an enlarged side view partially broken away showing in additional detail the positioning of swirl vanes in the annular passages between the concentric pipes.

BEST MODE FOR CARRYING OUT THE INVENTION

Figure 1:
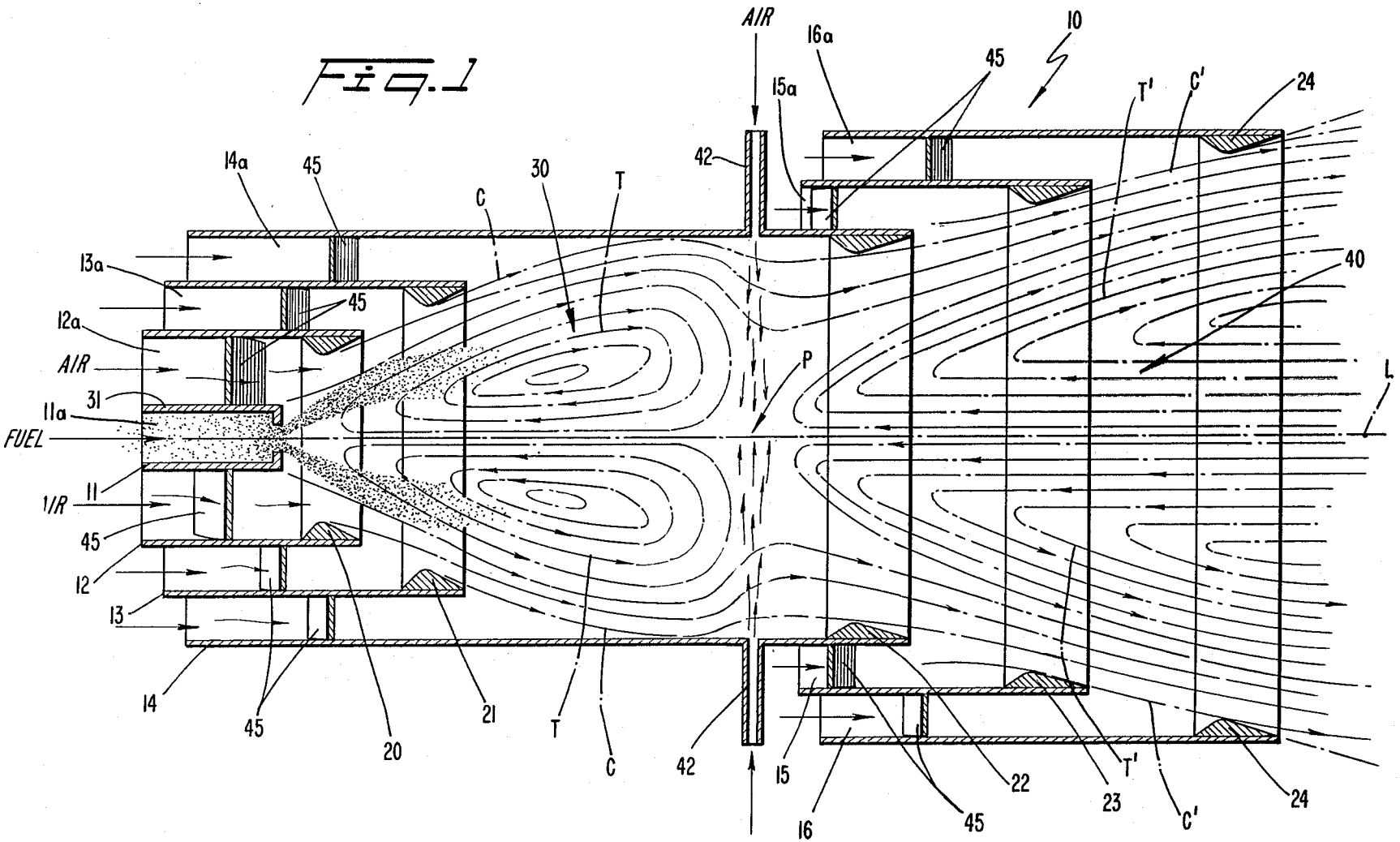
FIG. 1 is a schematic view of the gas turbine combustor according to the present invention showing the formation of fuel rich and fuel lean toroidal vortices respectively in the first and second combustion cavities.

Reference will now be made in detail to the present preferred embodiment of the invention as illustrated in the accompanying drawing. Referring first to FIG. 1, combustor 10 is shown comprising six pipes 11–16 of progressively larger diameter. These pipes may be mounted in a conventional manner (not shown) in a heat generating system, a power turbine or similar systems. The overlapping, substantially concentric alignment of the pipes 11–16 defines a central passage 11*a* and annular passages 12*a*–16*a* extending longitudinally between the corresponding pipe walls. Each of central and annular passages 11*a*–16*a* respectively defines a central intake opening and annular intake openings formed at one end of the pipes (note flow arrows in FIG. 1). Annular divergent nozzles 20–24 are respectively positioned within the outlet openings of the pipes 11–16 along the inner end of the inner pipes. These nozzles serve to form gaseous envelopes including toroidal vortices (see FIG. 1), this defining first and second combustion cavities or stages 30, 40, respectively. Fuel jet or inlet nozzle 31 is positioned within the central opening along combustor longitudinal axis L for supplying fuel to first cavity 30.

First cavity 30 forms a fuel rich stage of combustor 10 extending forwardly from fuel jet 31 along divergent nozzles 20–22. As shown, the axial spacing of these nozzles increases in relation to their radial distance from combustor axis L to define a divergent cavity with a substantially concave outer boundary. Second cavity 40 forms a fuel lean stage of combustor 10 along divergent nozzles 22–24. These secondary divergent nozzles are equally spaced apart in relation to their radial distance from burner axis L to define a second divergent cavity having a substantially straight-line outer boundary. This second stage is immediately downstream from first cavity 30. As shown in FIG. 1, each of first and second cavities 30, 40 includes three divergent nozzles and wherein outermost divergent nozzle 22 of the first cavity substantially defines the innermost nozzle of the second cavity.

As shown in FIG. 3, a plurality of turbine stator-type guide vanes 45 are positioned at spaced circumferential intervals in each of the annular openings for imparting a swirl velocity component to gaseous reactant entering the passages 12*a*–4*a*. The intake reactant may be supplied by a compressor (not shown). The rotation of the gaseous reactant about combustor axis L is a beneficial factor in the increased efficiency of combustion and the control of the gaseous temperatures in the two stages to reduce pollution in the exhaust, as will be explained in further detail below. Guide vanes 45 are secured to the inner pipe walls of each pair of pipes defining one of annular passages 12*a*–16*a*. Guide vanes 45 preferably have a fixed blade angle A (see FIG. 3) for rotating gaseous reactants about burner axis L. A more complete discussion of guide vanes 45 may be found in *Combustion Aerodynamics* by J. H. Beer and N. A. Chigier, Elsevier, 1972, Chapter 5.

In operation, liquid, gaseous, or slurry fuel is injected into the first cavity 30 through fuel jet or nozzle 31 and mixes with gaseous reactant supplied through divergent nozzles 20–22 of the first stage. The highly swirling gaseous reactant flow in combination with the divergence within first cavity 30 is operable to generate the toroidal vortex pattern, as indicated by streamlines T, (FIG. 1). In the second cavity 40, a second toroidal vortex with streamlines T' is generated within the envelope of the reactant entering the cavity through the annular passages 15*a*, 16*a*.

Each toroidal vortex extends longitudinally within a cavity and has a recirculating flow pattern along combustor axis L in the direction of fuel jet 31. A stagnation pressure area P exists slightly downstream of each toroidal vortex T, T'. To achieve proper flame stabilization and combustion in first cavity 30, the axial spacing between divergent nozzles 21, 22 must be sufficiently large for maintaining proper separation of the vortices T, T' in each cavity 30, 40, as discussed below. The first of these vortices constitutes the fuel rich stage of combustor 10 consisting of the fuel introduced along burner axis L and a proportion of the stoichiometric combustion air. Typically two-thirds of the stoichiometric combustion air is introduced through the three innermost pipes 12–14. The vigorous stirring in this zone is essential for the fast vaporization of the liquid fuel, the efficient conversion of fuel bound nitrogen to $N_2$, and also to avoid excessive formation of soot in the fuel rich zone. The second toroidal vortex T' formed in second cavity 40 embodies a fuel lean combustion stage in which the combustion products of the first stage are rapidly cooled to quench the thermal NOx formation reaction while maintaining the mixture temperature high enough for completing the combustion of carbon monoxide, hydrocarbons and soot leaving first cavity 30.

The cooling of the pipe walls (i.e. the sections of pipes 12–16 between divergent nozzles 20–24) is recuperative, enabling the total amount of gaseous reactant to cool the walls by flowing past them and return heat into the combustion system of first and second cavities 30, 40. This envelope surrounding the vortex reduces heat loss from the fuel rich stage which is desirable since high temperatures assist in speeding up the chemical reactions converting the fuel bound nitrogen to $N_2$. All of the gaseous reactant enters axially effectively cooling the pipe walls. There is no need to use part of the gaseous reactant as "film cooling" for the walls, thus enabling the total amount of gaseous reactant to be available for the efficient management of the flow and mixing pattern in combustor 10. The feature of providing good control over the flow and mixing pattern with a simple burner geometry further enables the pressure drop across the combustor to be maintained at lower levels than in conventional combustors operating at corresponding performance levels.

The gaseous reactant necessary for completing combustion and reducing temperature in the fuel lean zone of second cavity 40 is provided through divergent nozzles 22–24. Fast mixing between this gaseous reactant and the products of the fuel rich zone result in lowering the mixing temperature to below 1600° K., necessary for ensuring that little or no other NOx is formed, yet operable to maintain the temperature sufficiently high to burn the combustibles. High turbulent shear stresses arising between adjacent divergent nozzles result in uniform distribution of fluid properties, such as gas temperature, across the cross section of combustor 10, which is advantageous for gas turbine applications. If necessary, additional fuel, whether liquid, gaseous, or a slurry may be introduced at other positions along the burner, either axially through a ring jet (not shown) in the pipes, or tangentially through one or more of the pipe walls between adjacent divergent nozzles.

For the purpose of stabilizing the toroidal vortices and further strengthening the recirculating flow of the fuel rich vortex, throat means is provided for increasing stagnation pressure in the area P. As shown in FIG. 1, such means preferably includes a ring 42 of jets extending around pipe 14 between divergent nozzles 21, 22. Pressurized air is injected radially inward through ring jets 42 in this stagnation region P within the fuel rich toroidal vortex T. After combustion in the fuel rich vortex T, the combustion products from first cavity 30 pass downstream into second cavity 40 to complete combustion in the fuel lean vortex 40.

FIG. 2 shows a second embodiment of the present invention, wherein an additional pipe 14' is mounted between pipes 13, 14. A throat section pipe 14' is located between longitudinally spaced, adjacent nozzles 21, 22 (defining first and second cavities 30, 40). The throat is provided with annular convergent wall sections 14*a'* and divergent wall sections 14*b'*, thus defining a throat passage capable of separating the fuel rich and fuel lean vortices by increasing stagnation pressure at area P and reinforcing the recirculating flow of the fuel rich vortex. The feature of forming the throat in this manner also improves fast admixing of air in second cavity 40 with combustion products from first cavity 30 to quench thermal NOx formation reactions in the second cavity. In addition, strengthening of the recirculating fuel rich vortex is operable to return hot combustion products for mixing with fresh fuel to ensure flame stability.

To facilitate fast mixing between gaseous reactant supplied through adjacent annular passages 12*a*–16*a*, divergent nozzles 20–24 are contoured with venturi shaped axial sections. As shown in FIGS. 1 and 2, each divergent nozzle 20–24 is formed of a ring having a section converging inwardly a short distance to a minimum inside diameter and then diverging gradually toward the exhaust openings. The adjacent pipe ends of the annular exhaust openings are preferably flared to continue the divergence of each nozzle.

To increase the strength of the fuel rich vortex recirculation flow it is desirable to adjust the angle of guide vanes 45 to achieve a highest swirl velocity in the innermost annular passage. The swirl velocity then decreases gradually with increasing radial distance from burner axis L.

To improve the recirculation flow of the fuel rich toroidal vortex in first cavity 30, the axial distance between adjacent nozzles increases radially from burner axis L to define a concavely shaped envelope within the divergent cavity. This curved shape extends along the tips of divergent nozzles as shown by projection line C.

By axially spacing divergent nozzles 22–24 in second cavity 40 to achieve a frusto-conical contour extending along the nozzles (shown by straight projection line C'), greater control over thermal NOx formation is achieved.

The foregoing description of a preferred embodiment of the invention has been presented for purposes of illustration and description. It is not intended to be exhaustive or to limit the invention to the precise form disclosed, and obviously many modifications and variations are possible in light of the above teaching. This embodiment was chosen and described in order to best explain the principles of the invention and as practicable application to thereby enable others skilled in the art to best utilize the invention in various embodiments and with various modifications as are suited to the particular use contemplated. It is intended that the scope of the invention be defined by the claims appended hereto.

I claim:

1. A two stage rich-lean combustor operable with reduced emission of fuel bound and thermal nitrogen oxide products, said combustor comprising:

a. tubular wall means having successive tubular wall portions disposed in successive downstream locations and having respectively increasing dimensions in the radial direction to provide a generally outwardly diverging combustor envelope along the axial direction;

b. means for supporting said tubular wall portions relative to each other to provide a rigid structure for the combustor;

c. nozzle means for supplying fuel to said combustor in at least one predetermined location;

d. a first upstream grouping of said tubular wall portions comprising at least the first three wall portions defining a first oxygen deficient generally diverging zone for fuel rich low $NO_x$ combustion at high temperature;

e. each pair of adjacent tubular wall portions defining a generally annular flow path between the outer periphery of the downstream end region of the radially inward upstream wall portion of the pair and the inner periphery of the upstream end region of the radially outward downstream wall portion of the pair to receive pressurized and generally axially directed inlet air so that substantially all of the inlet air flow to said first rich combustion zone, other than any nozzle atomizing air flow or other special air flow that may be provided, passes through said annular flow paths associated with said first rich combustion zone at a rate limited to support rich combustion as defined;

f. first swirl means for imparting a tangential velocity to inlet air flow through the first and radially inmost annular flow path;

g. second swirl means for imparting a tangential velocity to inlet air flow through the second annular flow path located radially outwardly and axially downstream from the first annular flow path;

h. said first and second swirl means being interrelated to produce a first gradient in the tangential velocities of the inlet air flows through the first and second annular paths, and said first tangential velocity gradient being operative within the diverging envelope of said first rich combustion zone under operating inlet air pressure and gas axial velocity conditions to produce a toroidal vortex in said first rich combustion zone, with substantially all of the recirculating combustion air being recuperatively supplied by the swirling annular inlet flows after cooling the inner surfaces of said wall portions defining said first rich combustion zone;

i. a second downstream grouping of said tubular portions comprising at least fourth and fifth wall portions defining a second generally diverging excess oxygen zone for low $NO_x$ lean combustion at relatively low temperature enabled by inlet air swirling into the exit stream from said first rich combustion zone to cool the outlet gases therein and to burn residual combustibles therein with high excess air;

j. each pair of adjacent tubular wall portions including said third wall portion about the downstream end of said first rich combustion zone and said fourth and fifth wall portions in said second grouping defining a generally annular flow path between the outer periphery of the downstream end region of the radially inward upstream wall portion of the pair and the inner periphery of the upstream end region of the radially outward downstream wall portion of the pair to receive pressurized and generally axially directed inlet air so that substantially all of the inlet air flow to said second lean combustion zone, other than any nozzle atomizing or other special air flow that may be provided, passes through said annular flow paths associated with said second lean combustion zone at a rate sufficient to support lean combustion as defined;

k. third swirl means for imparting a tangential velocity to inlet air flow through the third annular flow path located radially outwardly and axially downstream from the second annular flow path;

l. fourth swirl means for imparting a tangential velocity to inlet air flow through the fourth annular flow path located radially outwardly and axially downstream from the third annular flow path;

m. said third and fourth swirl means being interrelated to produce a second gradient in the tangential velocities of the inlet air flows through the third and fourth annular paths, and said second tangential velocity gradient being operative within the diverging envelope of said second lean combustion zone under operating inlet air pressure and gas axial velocity conditions to produce a toroidal vortex in said second lean combustion zone, with substantially all of the recirculating combustion air being recuperatively supplied by the swirling annular inlet flows after cooling the inner surfaces of said wall portions defining said second lean combustion zone.

2. A combustor as set forth in claim 1 wherein said nozzle means is disposed about the combustor axis within the first of said three wall portions.

3. A combustor as set forth in claim 1 wherein said first and said second tangential velocity gradients decrease with increasing radius.

4. A two stage rich-lean combustor operable with reduced emission of fuel bound and thermal nitrogen oxide products, said combustor comprising:

a. tubular wall means having successive tubular wall portions disposed in successive downstream locations and having respectively increasing dimensions in the radial direction to provide a generally outwardly diverging combustor envelope along the axial direction;

b. means for supporting said tubular wall portions relative to each other to provide a rigid structure for the combustor;

c. nozzle means for supplying fuel to said combustor in at least one predetermined location;

d. a first upstream grouping of said tubular wall portions comprising at least the first four wall portions defining a first oxygen deficient generally diverging zone for fuel rich lean $NO_x$ combustion at high temperature;

e. each pair of adjacent tubular wall portions defining a generally annular flow path between the outer periphery of the downstream end region of the radially inward upstream wall portion of the pair and the inner periphery of the upstream end region of the radially outward downstream wall portion of the pair to receive pressurized and generally axially directed inlet air so that substantially all of the inlet air flow to said first rich combustion zone, other than any nozzle atomizing air flow or other special air flow that may be provided, passes through said annular flow paths associated with said first rich combustion zone at a rate limited to support rich combustion as defined;

f. first swirl means for imparting a tangential velocity to inlet air flow through the first and radially inmost annular flow path;

g. second swirl means for imparting a tangential velocity to inlet air flow through the second annular flow path located radially outwardly and axially downstream from the first annular flow path;

h. third swirl means for imparting a tangential velocity to inlet air flow through the third annular flow path located radially outwardly and axially downstream from the second annular path;

i. said first, second and third swirl means being interrelated to produce a first gradient in the tangential velocities of the inlet air flows through the first, second and third annular paths, and said first tangential velocity gradient being operative within the diverging envelope of said first rich combustion zone under operating inlet air pressure and gas axial velocity conditions to produce a toroidal vortex in said first rich combustion zone, with substantially all of the recirculating combustion air being recuperatively supplied by the swirling annular inlet flows after cooling the inner surfaces of said wall portions defining said first rich combustion zone;

j. a second downstream grouping of said tubular wall portions comprising at least fifth and sixth wall portions defining a second generally diverging excess oxygen zone for low $NO_x$ lean combustion at relatively low temperature enabled inlet air swirling into the exit stream from said first rich combustion zone to cool the outlet gases therein and to burn residual combustibles therein with high excess air;

k. each pair of adjacent tubular wall portions including said fourth wall portion about the downstream end of said first rich combustion zone and said fifth and sixth wall portions in said second grouping defining a generally annular flow path between the outer periphery of the downstream end region of the radially inward upstream wall portion of the pair and the inner periphery of the upstream end region of the radially outward downstream wall portion of the pair to receive pressurized and generally axially directed inlet air so that substantially all of the inlet air flow to said second lean combustion zone, other than any nozzle atomizing or other special air flow that may be provided, passes through said annular flow paths associated with said second lean combustion zone at a rate sufficient to support lean combustion as defined;

l. fourth swirl means for imparting a tangential velocity to inlet air flow through the fourth annular flow path located radially outwardly and axially downstream from the third annular flow path;

m. fifth swirl means for imparting a tangential velocity to inlet air flow through the fifth annular flow path located radially outwardly and axially downstream from the fourth annular flow path;

n. said fourth and fifth swirl means being interrelated to produce a second gradient in the tangential velocities of the inlet air flows through the fourth and fifth annular paths, and said second tangential velocity gradient being operative within the diverging envelope of said second lean combustion zone under operating inlet air pressure and gas axial velocity conditions to produce a toroidal vortex in said second lean combustion zone, with substantially all of the recirculating combustion air being recuperatively supplied by the swirling annular inlet flows after cooling the inner surfaces of said wall portions defining said second lean combustion zone.

5. A combustor as set forth in claim 1, wherein the outlet ends of said wall portions disposed about said rich combustion zone are so located as to define for said rich combustion zone a generally divergent envelope concave toward the combustor axis thereby enhancing the separation of said rich and lean combustion zones and enabling quick reduction of the gas temperature by the fast admixing of combustion air to said rich combustion products so as to avoid the formation of thermal $NO_x$ during subsequent combustion of the remaining combustibles.

6. A combustor as set forth in claim 1, wherein the outlet ends of said wall portions disposed about said lean combustion zone are so located as to define a substantially straight line conical envelope for said lean combustion zone thereby supporting a central toroidal recirculation flow which is instrumental to reduced formation of thermal $NO_x$.

7. A combustor as set forth in claim 5, wherein the outlet ends of said wall portions dispose about said lean combustion zone are so located as to define a substantially straight line conical envelope for said lean combustion zone thereby supporting a central toroidal recirculation flow which is instrumental to reduced formation of thermal $NO_x$.

8. A combustor as set forth in claim 1, wherein said swirl means each comprise a plurality of guide vanes secured between said wall portions in said annular paths to define the tangential velocity of each resultant inlet swirling flow and to support said wall portions relative to each other.

9. A combustor as set forth in claim 8, wherein said guide vanes are so structured and angularly disposed as to produce for in each combustion zone axially spaced swirling flows having respective tangential velocities which decrease with increasing wall portion radius.

10. A combustor as set forth in claim 5, wherein the outermost wall portion about said rich combustion zone is provided with reduced radius throat means located between said rich fuel and lean fuel combustion zones to enhance the separation of the rich and lean vortices.

11. A two stage rich-lean combustor operable with reduced emission of fuel bound and thermal nitrogen oxide products, said combustor comprising:

a. a plurality of overlapping annular rings disposed in successive downstream locations and having respectively increasing dimensions in the radial direction to provide a generally outwardly diverging combustor envelope along the axial direction;

b. means for supporting said rings relative to each other to provide a rigid structure for the combustor;

c. nozzle means for supplying fuel to said combustor in a one predetermined location;

d. a first upstream grouping of said rings comprising at least the first three rings defining a first oxygen deficient generally diverging zone for fuel rich lean $NO_x$ combustion at high temperature;

e. each pair of adjacent rings defining a generally annular flow path between the outer periphery of the downstream end region of the radially inward upstream ring of the pair and the inner periphery of the upstream end region of the radially outward downstream ring of the pair to receive pressurized and generally axially directed inlet air so that substantially all of the inlet air flow to said first rich combustion zone, other than any nozzle atomizing air flow or other special air flow that may be provided, passes through said annular flow paths associated with said first rich combustion zone at a rate limited to support rich combustion as defined;

f. first swirl means for imparting a tangential velocity to inlet air flow through the first and radially inmost annular flow path;

g. second swirl means for imparting a tangential velocity to inlet air flow through the second annular flow path located radially outwardly and axially downstream from the first annular flow path;

h. said first and second swirl means being interrelated to produce a gradient in the tangential velocities of the inlet air flows through the first and second annular paths, and said first tangential velocity gradient being operative within the diverging envelope of said first rich combustion zone under operating inlet air pressure and gas axial velocity conditions to produce a toroidal vortex in said first rich combustion zone, with substantially all of the recirculating combustion air being recuperatively supplied by the swirling annular inlet flows after cooling the inner surfaces of said rings defining said first rich combustion zone;

i. a second downstream grouping of said rings comprising at least fourth and fifth rings defining a second generally diverging excess oxygen zone for low $NO_x$ lean combustion at relatively low temperature enabled by inlet air swirling into the exit stream from said first rich combustion zone to cool the outlet gases therein and to burn residual combustibles therein with high excess air;

j. each pair of adjacent rings including said third ring about the downstream end of said first rich combustion zone and said fourth and fifth rings in said second grouping defining a generally annular flow path between the outer periphery of the downstream end region of the radially inward upstream ring of the pair and the inner periphery of the upstream end region of the radially outward downstream ring of the pair to receive pressurized and generally axially directed inlet air so that substantially all of the inlet air flow to said second lean combustion zone, other than any nozzle atomizing or other special air flow that may be provided, passes through said annular flow paths associated with said second lean combustion zone at a rate sufficient to support lean combustion as defined;

k. third swirl means for imparting a tangential velocity to inlet air flow through the third annular flow path located radially outwardly and axially downstream from the third annular flow path;

l. fourth swirl means for imparting a tangential velocity to inlet air flow through the fourth annular flow path located radially outwardly and axially downstream from the third annular flow path;

m. said third and fourth swirl means being interrelated to produce a second gradient in the tangential velocities of the inlet air flows through the third and fourth annular paths, and said second tangential velocity gradient being operative within the diverging envelope of said second lean combustion zone under operating inlet air pressure and gas axial velocity conditions to produce a toroidal vortex in said second lean combustion zone, with substantially all of the recirculating combustion air being recuperatively supplied by the swirling annular inlet flows after cooling the inner surfaces of said rings defining said second lean combustion zone.

12. A combustor as set forth in claim 11, wherein the outlet ends of said rings disposed about said rich combustion zone are so located as to define for said rich combustion zone a generally divergent envelope concave toward the combustor axis thereby enhancing the separation of said rich and lean combustion zones and reducing the gas temperature by the fast admixing of combustion air to said rich combustion products so as to avoid the formation of thermal $NO_x$ during subsequent combustion of the remaining combustibles.

13. A combustor as set forth in claim 11, wherein the outlet ends of said rings disposed about said lean combustion zone are so located as to define a substantially straight line conical envelope for said lean combustion zone thereby supporting a central toroidal recirculation flow which is instrumental to reduced formation of thermal $NO_x$.

14. A combustor as set forth in claim 13, wherein two rings are provided about said lean combustion zone with the outlet end of the largest rich combustion zone ring forming the inlet of said lean combustion zone.

15. A combustor as set forth in claim 11, wherein said supporting means and said swirl means comprise a plurality of guide vanes secured between said rings in said annular paths to define the tangential velocity of each resultant inlet swirling flow.

16. A combustor as set forth in claim 15, wherein said guide vanes are so structured and angularly disposed as to produce in each combustion zone swirling flows having respective tangential velocities which decrease with increasing ring radius.

17. A combustor as set forth in claim 12, wherein the outermost ring about said rich combustion zone is provided with reduced radius throat means located between said rich fuel and lean combustion zones to enhance the separation of the rich and lean vortices, the outlet end of said outermost ring having a smaller radii than that of the outlet end of the next smaller ring about said rich combustion zone.

18. A combustor as set forth in claim 17, wherein said throat means includes means for injecting a gaseous flow radially inwardly toward the burner axis near a pressure stagnation point in the space between said vortices.

19. A combustor as set forth in claim 12, wherein venturi-shaped nozzle means are disposed near the outlet of each of said rings about said combustion zones.

20. A combustor as set forth in claim 11, wherein said rings are cylindrical in shape.

21. A combustor as set forth in claim 11 wherein said one predetermined fuel supply location is along the combustor axis near its upstream end.

22. A rich-lean combustor having at least one combustion stage and operable with reduced emission of fuel bound and thermal nitrogen oxide products, said combustor comprising:

a. tubular wall means having at least three successive tubular wall portions disposed in successive downstream locations and having respectively increasing dimensions in the radial direction to provide a generally outwardly diverging combustor envelope along the axial direction that defines an outwardly diverging combustion zone for low $NO_x$ combustion;

b. means for supporting said tubular wall portions relative to each other to provide a rigid structure for the combustor;

c. nozzle means for supplying fuel to said combustor in at least one predetermined location;

d. each successive pair of adjacent tubular wall portions being structured to define a generally annular inlet flow path extending in the radial direction between the outer surface of the radially inward upstream wall portion of the pair and the inner surface of the radially outward downstream wall portion of the pair and further extending downstream in the axial direction along the inner surface of the radially outward downstream wall portion of the pair so that successive annular flow paths axially overlap, to enable the annular flows to combine at least partly for swirling radially inward flow into said combustion zone, said wall portions further being sized and structurally coordinated so that the total annular air flow includes substantially all of the pressurized inlet air flow needed for complete fuel burning in said combustion zone, other than any nozzle atomizing air flow or other special air flow that may be provided and such that the combustion air flows inwardly at a rate needed to support rich combustion along the axial region of said combustion zone thereby enabling leaner combustion radially outwardly and axially downstream thereof within said combustion zone;

e. first swirl means for imparting a tangential velocity to inlet air flow through the first and radially inmost annular flow path;

f. second swirl means for imparting a tangential velocity to inlet air flow through the second annular flow path located radially outwardly and axially downstream from the first annular flow path; and g. said first and second swirl means being interrelated to produce a negative radial gradient in the tangential velocities of the inlet air flows through the first and second annular paths, said tangential velocities decreasing with increasing radius and being operative within the diverging envelope of said combustion zone under operating inlet air pressure and gas axial velocity conditions to produce a depression of the axial velocity on the combustor axis with substantially all of the combustion air being recuperatively supplied by the swirling annular inlet flows after cooling the inner surfaces of said wall portions defining said combustion zone.

23. A combustor as set forth in claim 22 wherein said nozzle means is disposed about the combustor axis within the first of said three wall portions.

24. A rich-lean combustor having at least one combustion stage and operable with reduced emission of fuel bound and thermal nitrogen oxide products, said combustor comprising:

a. tubular wall means having at least four successive tubular wall portions disposed in successive downstream locations and having respectively increasing dimensions in the radial direction to provide a generally outwardly diverging combustor envelope along the axial direction that defines an outwardly diverging combustion zone for low $NO_x$ combustion;

b. means for supporting said tubular wall portions relative to each other to provide a rigid structure for the combustor;

c. nozzle means for supplying fuel to said combustor in at least one predetermined location;

d. each successive pair of adjacent tubular wall portions being structured to define a generally annular inlet flow path extending in the radial direction between the outer surface of the radially inward upstream wall portion of the pair and the inner surface of the radially outward downstream wall portion of the pair and further extending downstream in the axial direction along the inner surface of the radially outward downstream wall portion of the pair so that successive annular flow paths axially overlap to enable the annular flows to combine at least partly for swirling radially inward flow into said combustion zone said wall portions further being sized and structurally coordinated so that the total annular air flow includes substantially all of the pressurized inlet air flow needed for complete fuel burning in said combustion zone other than any nozzle atomizing air flow or other special air flow that may be provided, and such that the combustion air flows inwardly at a rate needed to support rich combustion along the axial region of said combustion zone thereby enabling leaner combustion radially outwardly and axially downstream thereof within said combustion zone;

e. first swirl means for imparting a tangential velocity to inlet air flow through the first and radially inmost annular flow path;

f. second swirl means for imparting a tangential velocity to inlet air flow through the second annular flow path located radially outwardly and axially downstream from the first annular flow path; g. third swirl means for imparting a tangential velocity to inlet air flow through the third annular flow path located radially outwardly and axially downstream from the second annular path; and h. said first, second and third swirl means being interrelated to produce a negative radial gradient in the tangential velocities of the air flows through the first, second and third annular paths, said tangential velocities decreasing with increasing radius and being operative within the diverging envelope of said combustion zone under operating inlet air pressure and gas axial velocity conditions to produce a depression of the axial velocity on the combustor axis with substantially all of the combustion air being recuperatively supplied by the swirling annular inlet flows after cooling the inner surfaces of said wall portions defining said combustion zone.

25. A combustor as set forth in claim 22, wherein said swirl means each comprise a plurality of guide vanes secured between said wall portions in said annular paths to define the tangential velocity of each resultant inlet swirling flow and to support said wall portions relative to each other.

26. A combustor as set forth in claim 24, wherein said guide vanes are so structured and angularly disposed as to produce axially spaced swirling flows having respective tangential velocities which decrease with increasing wall portion radius.

27. A rich-lean combustor having at least one combustion stage and operable with reduced emission of fuel bound and thermal nitrogen oxide products, said combustor comprising:

a. at least three overlapping annular rings disposed in successive downstream locations and having respectively increasing dimensions in the radial direction to provide a generally outwardly diverging combustor envelope along the axial direction that defines an outwardly diverging combustion zone for low $NO_x$ combustion;

b. means for supporting said ring relative to each other to provide a rigid structure for the combustor;

c. nozzle means for supplying fuel to said combustor in at least one predetermined location;

d. each successive pair of adjacent rings defining a generally annular flow path between flow path between the outer periphery or downstream end region of the radially inward upstream ring of the pair and the inner periphery of the upstream end region of the radially outward downstream ring of the pair to receive pressurized and generally axially directed inlet air so that substantially all of the inlet air flow to said combustion zone, other than any nozzle atomizing air flow or other special air flow that may be provided, passes through said annular flow paths at a rate needed to support rich combustion along the axial region of said combustion zone thereby enabling leaner combustion to occur radially outwardly thereof within said combustion zone;

e. first swirl means for imparting a tangential velocity to inlet air flow through the first and radially inmost annular flow path;

f. second swirl means for imparting a tangential velocity to inlet air flow through the second annular flow path located radially outwardly and axially downstream from the first annular flow path; and g. said first and second swirl means being interrelated to produce a gradient in the tangential velocities of the inlet air flows through the first and second annular paths, said tangential velocity gradient decreasing with increasing radius and being operative within the diverging envelope of said combustion zone under operating inlet air pressure and gas axial velocity conditions to produce a toroidal vortex in said combustion zone, with substantially all of the recirculating combustion air being recuperatively supplied by the swirling annular inlet flows after cooling the inner surfaces of said rings defining said combustion zone.

28. A combustor as set forth in claim 27, wherein said supporting means and said swirl means comprise a plurality of guide vanes secured between said rings in said annular paths to define the tangential velocity of each resultant inlet swirling flow.

29. A combustor as set forth in claim 28 wherein said guide vanes are so structured and angularly disposed as to produce in said combustion zone swirling flows having respective tangential velocities which decrease with increasing ring radius.

30. A combustor as set forth in claim 27 wherein said one predetermined fuel supply location is along the combustor axis near its upstream end.

* * * * *